US010843199B2

(12) United States Patent
Munkel et al.

(10) Patent No.: US 10,843,199 B2
(45) Date of Patent: Nov. 24, 2020

(54) GRANULES CONDITIONER

(71) Applicant: Maschinenfabrik Gustav Eirich GmbH & Co. KG, Hardheim (DE)

(72) Inventors: Stefan Munkel, Kulsheim (DE); Andreas Seiler, Tauberbischofsheim (DE); Stefan Gerl, Werbach (DE)

(73) Assignee: Maschinenfabrik Gustav Eirich GmbH & Co. KG, Hardheim (DE)

( * ) Notice: Subject to any disclaimer, the term of this patent is extended or adjusted under 35 U.S.C. 154(b) by 817 days.

(21) Appl. No.: 14/765,279

(22) PCT Filed: Mar. 18, 2014

(86) PCT No.: PCT/EP2014/055384
§ 371 (c)(1),
(2) Date: Jul. 31, 2015

(87) PCT Pub. No.: WO2014/154525
PCT Pub. Date: Oct. 2, 2014

(65) Prior Publication Data

US 2015/0367350 A1 Dec. 24, 2015

(30) Foreign Application Priority Data

Mar. 25, 2013 (DE) ..... 10 2013 103 012

(51) Int. Cl.
*B02C 7/02* (2006.01)
*B02C 7/00* (2006.01)
(Continued)

(52) U.S. Cl.
CPC ..... *B02C 7/02* (2013.01); *B02C 7/00* (2013.01); *B02C 7/08* (2013.01); *B02C 7/11* (2013.01);
(Continued)

(58) Field of Classification Search
CPC ..... B02C 7/02–08; B02C 7/14; B02C 7/184; B02C 23/02; B02C 7/11; B02C 7/186; D21D 1/303; D21D 1/306
(Continued)

(56) References Cited

U.S. PATENT DOCUMENTS 416,371 A * 12/1889 Millot ..... B02C 7/184 241/297
1,670,714 A * 5/1928 Craig ..... B02C 7/184 241/253
(Continued)

FOREIGN PATENT DOCUMENTS

BE 476 988 A 10/1947
CN 2875585 Y 3/2007
(Continued)

OTHER PUBLICATIONS

The State Intellectual Property Office of the Peoples Republic of China, Appln. No. 201480010158.5, Office Action, dated Aug. 19, 2016, and English translation.
(Continued)

*Primary Examiner* — Shelley M Self
*Assistant Examiner* — Smith Oberto Bapthelus
(74) *Attorney, Agent, or Firm* — Paul & Paul

(57) ABSTRACT

The present invention concerns a granular material conditioner for optimising grain sizes of granular materials comprising two discs which are rotatable relative to each other and which are arranged in substantially mutually parallel relationship, a granular material inlet through which granular material can be passed into the conditioner into an annular gap between the two discs, and a catch container for receiving the granular material which issues from the gap between the two discs by virtue of centrifugal force. According to the invention it is proposed that the catch container
(Continued)

has an elastic curtain, wherein the curtain is spaced at least portion-wise from the catch container wall and limits the trajectory of the granular material issuing from the gap.

15 Claims, 3 Drawing Sheets

(51) Int. Cl.
*B02C 7/08* (2006.01)
*B02C 7/11* (2006.01)
*B02C 23/02* (2006.01)
*D21D 1/30* (2006.01)

(52) U.S. Cl.
CPC ..... *B02C 23/02* (2013.01); *D21D 1/303* (2013.01); *D21D 1/306* (2013.01)

(58) Field of Classification Search
USPC ..... 241/246, 257.1, 259, 261.2, 261.3, 74
See application file for complete search history.

(56) References Cited

U.S. PATENT DOCUMENTS 1,717,860 A * 6/1929 Warren ..... B02C 7/08 241/162
1,797,779 A * 3/1931 Legrand ..... B02C 7/06 241/242
1,937,788 A * 12/1933 Ross ..... B02C 7/06 241/101.3
2,914,797 A 12/1959 Cavanagh
2,937,815 A * 5/1960 Eirich ..... B02C 7/08 241/245
3,531,562 A * 9/1970 Serrano ..... B29B 17/0412 264/117
3,568,940 A * 3/1971 Merges ..... B02C 7/04 241/247
3,799,456 A * 3/1974 Jewell ..... B02C 7/14 241/259.2
3,926,380 A * 12/1975 Musgrove ..... B02C 7/08 241/248
4,257,564 A * 3/1981 Pamplin ..... B02C 7/10 241/252
4,298,425 A * 11/1981 Ranzen ..... D21B 1/30 162/18
4,342,383 A 8/1982 Burnett
4,932,595 A * 6/1990 Cohen ..... B02C 19/0093 241/246
4,973,000 A * 11/1990 Akerblom ..... B02C 7/14 241/101.3
5,620,145 A * 4/1997 Masuda ..... B02C 7/08 241/19
5,836,523 A * 11/1998 Johnson ..... B02C 7/08 241/5
6,045,070 A * 4/2000 Davenport ..... B02C 7/04 175/206
6,230,995 B1 * 5/2001 Niemi ..... B02C 7/04 241/152.1
7,152,823 B2 * 12/2006 Kapper ..... B02C 7/04 241/261.2
2007/0029423 A1 * 2/2007 Sanagi ..... B02C 7/08 241/261.2
2010/0163657 A1 7/2010 Lehtonen et al.
2015/0367350 A1 * 12/2015 Munkel ..... B02C 7/00 241/246

FOREIGN PATENT DOCUMENTS

DE 1 507 574 A1 7/1969
DE 42 23 872 A1 1/1994
DE 44 38 105 A1 5/1996
DE 103 61 308 A1 7/2005
EP 1 070 543 A1 1/2001
EP 1964611 A1 9/2008
FR 2 302 784 A1 10/1976
FR 2 516 811 A1 5/1983
GB 120931 A 4/1919
JP 2011/067794 A 4/2011
WO 99 06141 A1 2/1999
WO 2005/030659 A1 4/2005
WO 2007/069764 A1 6/2007
WO 2011/036949 A1 3/2011

OTHER PUBLICATIONS

Agnes Wittmann-Regis, "International Preliminary Report on Patentability," PCT/EP2014/055384, International Bureau of the World Intellectual Property Organization, dated Oct. 8, 2015.
Teruki Amano, Japanese Patent Office, Office Action, Japanese Patent Application No. 2016-503634, dated Jun. 27, 2017 (English translation).

* cited by examiner

GRANULES CONDITIONER

CROSS-REFERENCE TO RELATED APPLICATION

This is a national stage 371 application of International Application No. PCT/EP2014/055384, filed Mar. 18, 2014.

The present invention concerns a granular material conditioner for optimising grain sizes of granular materials.

Particularly in technical ceramics ceramic granular materials with a high degree of pourability are required. Therefore the grain sizes should lie within a predetermined grain size range. Both granular material proportions with excessively large grain sizes and also those with excessively small grain sizes are frequency unwanted.

The process for the production of granular materials in technical ceramics, which is to be most frequency encountered, is spray drying. For that purpose fine powders are mixed with liquid to constitute a suspension. That is then granulated in a spray dryer, that is to say the suspension is atomised by way of a nozzle system or centrifugal discs in a hot atmosphere. The resulting droplets are dried in the drying room by hot air which is passed in counter-flow relationship with the droplets. The particles contained in the droplets agglomerate together and form granular materials. The residual moisture and the granular material size distribution can be influenced inter alia on the basis of the nozzle geometry. The advantage of that process which has been established for decades lies in the high granular material yield in the range of 100-800 μm. The disadvantage lies in the large amount of liquid which is necessary for the spray operation and which first has to be fed to the solids and which then has to be almost completely dried out again.

An alternative process for the production of granular materials is so-called growth agglomeration. There the starting materials are fed in the form of powder particles to a mixer. After the addition of water and possibly organic binders agglomerates or granular materials are formed by the mixing movement.

Growth agglomeration is economically markedly more advantageous but results in a worse grain size distribution as large granules form very quickly with diameters markedly above 1000 μm. The granular material therefore has to be processed.

Granular material conditioners are known for example from EP 1 070 543, with which the grain sizes of granular materials can be reduced. They have an element which is rotatable relative to a stationary housing, the rotatable element having portions in the shape of the surface of a cone. Between the portions in the shape of the surface of a cone and the stationary housing is a gap which extends conically in cross-section, by virtue of the differing cone angles. The granular material particles to be processed are passed through the gap and comminuted thereby. The exit gap is arranged very close to the housing wall.

When using granular materials for technical ceramics and in particular in relation to granular materials which were produced by means of growth agglomeration and which therefore generally involve a moisture content of between 10 and 15% immediately after production, it frequently happens in the granular material conditioners, in particular in the ejection zone and at the stationary housing, that large agglomerates and lumps adhere together and are re-formed, and such agglomerates and lumps severely adversely affect the quality of the optimised granular material.

Disc mills are also known, which use two discs which are rotatable relative to each other and which are arranged in substantially mutually parallel relationship, with a tooth arrangement on the top side, wherein the material to be ground is introduced into a substantially annular gap between the two discs. Due to the relative rotary movement, in which case generally one of the two discs is stationary while the other disc rotates about its disc axis, the material to be ground is ground in the gap by the shearing action at the teeth. Such disc mills cannot be used for conditioning growth agglomerates or granular materials as the spaces between the teeth are gummed up by the moisture and the particles and the mill is clogged. Typical areas of use of those types of mill are grinding dry mineral raw materials, plastic materials or paper suspensions.

The use of those machines is also not possible for granular materials for technical ceramics and in particular for granular materials which were produced by means of growth agglomeration and which therefore generally have a freely moveable moisture of between 10 and 15% immediately after production.

The two discs of the disc mills are arranged within a housing which generally closely embraces the discs, for receiving the material which issues from the gap between the two discs by virtue of centrifugal force. In other words the starting components are ground by the relative movement of the two discs in the gap between the two discs and are flung outwardly by virtue of centrifugal force so that they impinge against the wall of the catch container. If such a disc mill were used for the processing of granular materials then the granular material issuing from the grinding discs would remain adhering to the rigid wall of the housing, which as the end result means that the granular material grains form lumps so that the quality of the granular material leaving the disc mill is worsened again.

Starting from the described state of the art therefore the object of the present invention is to provide a granular material conditioner with which granular materials which have been produced with a granulating mixer from fine powders with the addition of a liquid and which have a moisture content in the range of about 10 to 15% can be processed.

According to the invention that object is attained by a granular material conditioner which is of a similar structure to a disc mill, that is to say comprising two discs which are rotatable relative to each other and which are arranged in substantially mutually parallel relationship, a granular material inlet through which granular material can be passed into the conditioner into an annular gap between the two discs, and a catch container for receiving the granular material which issues from the gap between the two discs by virtue of centrifugal force. It will be noted however that the catch container has an elastic curtain, which is spaced at least portion-wise from the catch container wall and is so arranged that it limits the trajectory of the granular material issuing from the gap.

In other words an elastic material is suspended in the catch container in such a way that the granular materials issuing from the annular gap by virtue of the centrifugal force impact against the elastic curtain. Because the curtain is at a certain spacing relative to the catch container wall it can correspondingly move whereby the probability of the granular material adhering to the elastic curtain is markedly reduced. In principle the elastic curtain can be formed from any elastic material, in particular from any polymer material, in particular from any elastomer. The elastic curtain particularly preferably comprises polyurethane.

In a preferred embodiment the elastic curtain is arranged completely surrounding the pair of discs. That has the advantage that granular material issuing substantially over the entire disc periphery impinges on the elastic curtain and from there generally drops without adhering into the catch container.

It has been found that the curtain is advantageously of a bell-shaped configuration. In that case the curtain adjoins one of the two discs as far as possible over the entire periphery.

In that respect in a preferred embodiment the form of the elastic curtain is such that the elastic curtain includes an angle of between 15° and 75°, preferably between 25° and 65° and best between 35° and 45° with a notional radial prolongation of the annular gap. The result of this is that the granular material balls issuing from the annular gap impact against the elastic curtain substantially at the same angle.

More specifically it has been found that an excessively large impact angle cannot prevent the granular material from adhering to the elastic curtain. With an excessively small impact angle the catch container has to be markedly larger, which increases the costs for the granular material conditioner without this being linked to an additional benefit.

In a preferred embodiment the elastic curtain is of an S-shaped cross-section, that is to say it has a concave region closer to the gap and a convex region adjoining the concave region. Preferably a notional radial prolongation of the annular gap intersects the elastic curtain substantially in the proximity of the connection between the concave region and the convex region.

It has further been found that the elastic curtain is substantially smooth at least at the side towards the gap, that is to say it has neither knobs, grooves nor ribs. In a further preferred embodiment both discs are rotatable about their disc axis. It has been found that this measure avoids the possibly moist granular material becoming stuck and clogged between the discs, that is to say within the annular gap. If both discs rotate they must be driven at differing speeds. The direction of rotation of the rotating discs can in that case be either the same direction or the opposite direction.

In a preferred embodiment a disc has a central opening, by way of which the granular material can be supplied. For example the disc which has the central opening can be drivable with a hollow shaft, through which the granular material can be fed into the gap by way of the central opening.

For example the two discs can be oriented horizontally. In that case the upper disc should have the central opening, by way of which the granular material can be fed into the gap by means of the force of gravity.

To be able to adjust the granular material size a preferred embodiment provides a device for adjusting the gap width. In a particularly preferred embodiment the adjustable disc is mounted adjustably by way of three mounting points so that, besides the gap width, it is also possible to adjust the parallelism of the discs relative to each other by individual adjustment of the mounting points.

If nonetheless the granular material should become stuck fast and clogged in the annular gap, a preferred embodiment provides a pivot device, by means of which a disc, preferably the upper disc, can be pivoted about a pivot axis extending parallel to the plane of the gap to ensure access to the gap. The clinging material can then be removed and the conditioner is ready for use again.

It is further advantageous if the discs are substantially flat at their surfaces forming the gap. Because the discs do not have any tooth arrangement the risk of deposits is further reduced.

In a further particularly preferred embodiment the granular material conditioner is arranged in the same housing as a granulating mixer. The two components together form an apparatus for the production of an optimised granular material.

Further advantages, features and possible uses of the present invention will be apparent from the following description of a preferred embodiment and the accompanying Figures in which.

Figure 1:
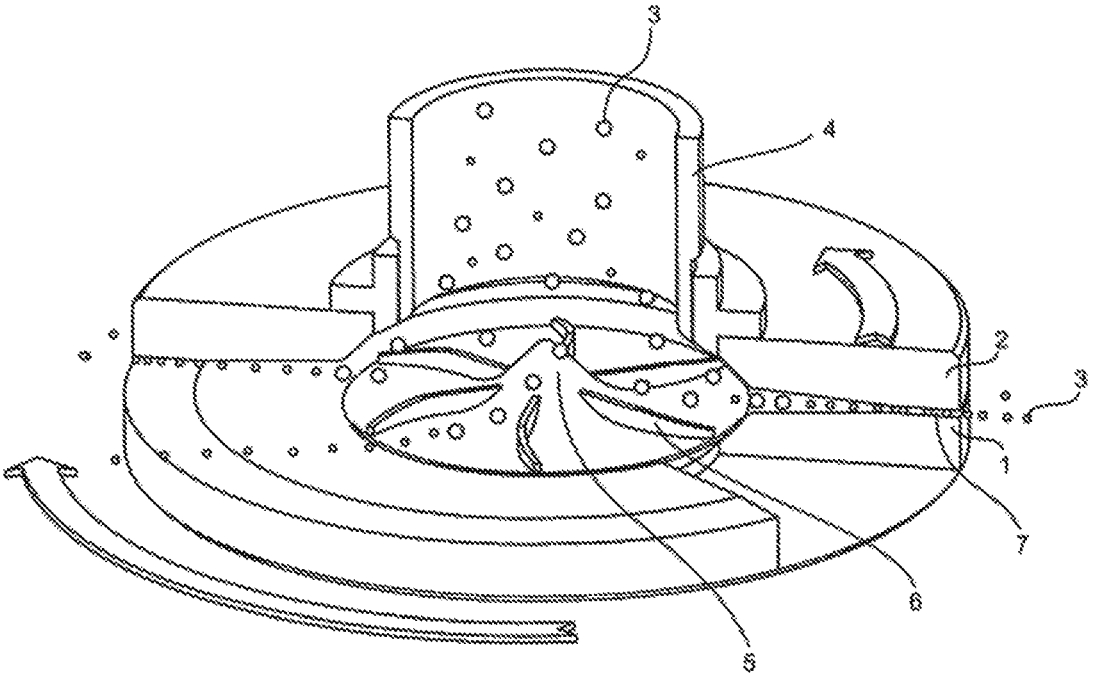
FIG. 1 is a diagrammatic view of the operating principle of the granular material conditioner or conditioning device 100.

FIG. 1 diagrammatically shows the operating principle of the conditioner according to the invention. The conditioner has two rotating discs 1, 2 which are driven in such a way that they rotate relative to each other. In the illustrated example the two discs are driven in different directions. An annular gap 7 remains between the two discs. The upper disc 2 is driven by means of a hollow shaft or granular material inlet 4 through which granular material to be optimised can be fed. The lower disc 1 has at the centre a central cone 5 and a row of vanes 6. The granular material which is passed by way of the hollow shaft 4 between the discs under the effect of the force of gravity is moved radially outwardly by the cone 5 and the vanes 6 so that it is transported into the annular gap 7 by virtue of the radial acceleration. In the gap the granular material is comminuted until it issues again from the annular gap 7 at the periphery thereof.

It will be seen that the annular gap 7 has a conically converging portion which is arranged radially further inwardly and a portion in which the gap remains substantially constant and which adjoins the conically converging portion so that it is arranged radially further outwardly.

The granular material is comminuted in the conically converging portion so that the granular material can be subsequently rolled in the radially outwardly adjoining gap portion of a substantially constant gap width. As an alternative thereto it would also be possible to provide a plurality of conically converging portions.

The discs shown in FIG. 1 are usually mounted in a catch container.

Figure 2:
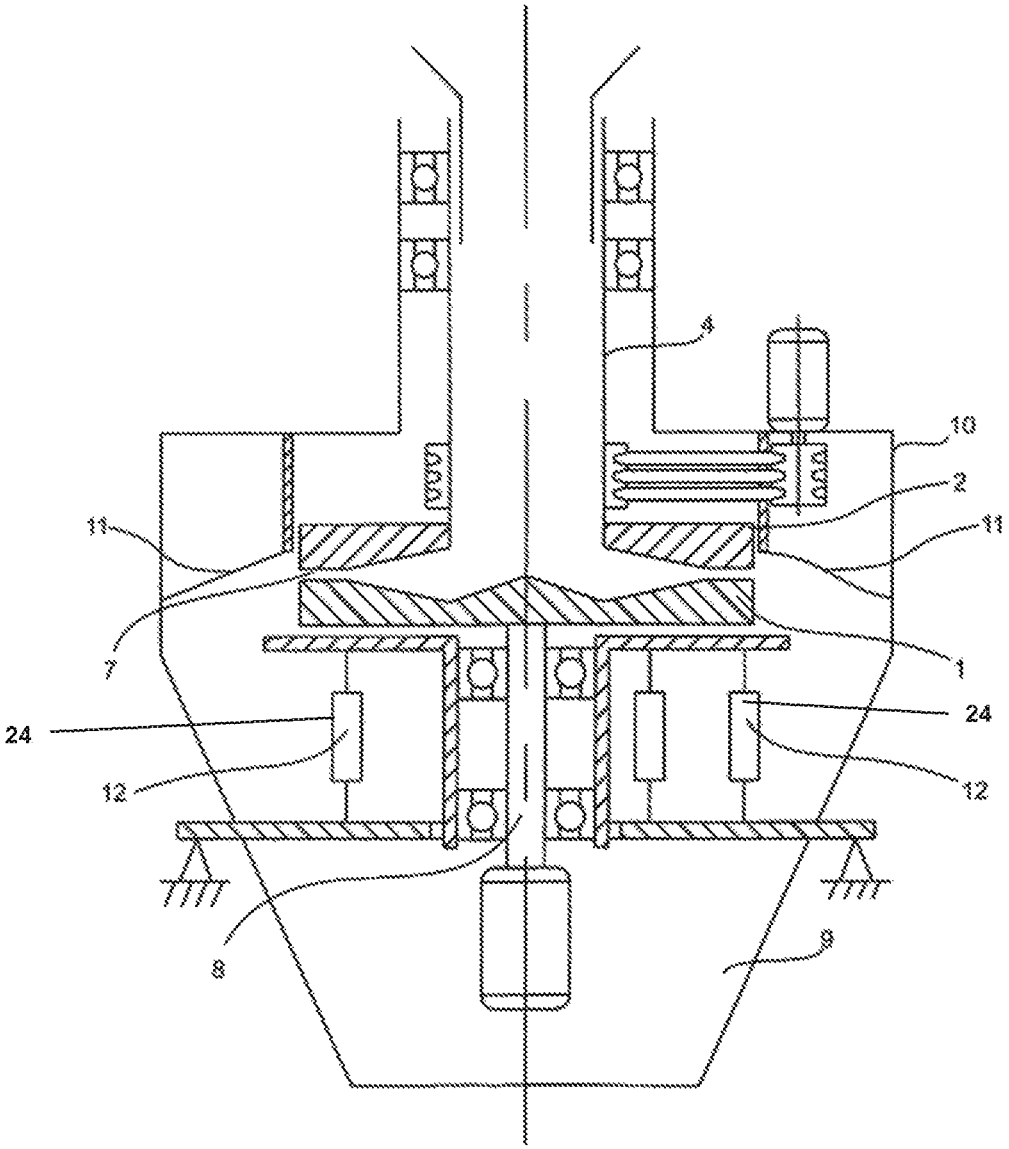
FIG. 2 shows a sectional view through a part of a conditioner 100 according to the invention.

FIG. 2 shows an embodiment of the invention. The conditioner is shown here as a sectional view. As far as possible the same references are used as those in FIG. 1. Here too the granular material can be supplied by way of the hollow shaft 4. The lower disc 1 is driven by way of the shaft 8 while the upper disc 2 is driven by way of the hollow shaft 4. The granular material is comminuted in the annular gap 7 and radially accelerated by the rotating discs so that it issues from the annular gap 7 at the periphery at a not inconsiderable speed. In the known conditioners the issuing granular material impacts against the housing wall which closely surrounds the ejection gap and is conveyed from there in the direction of the granular material discharge for example by means of rotating clearing-out fingers.

Particularly when the granular material is of average moisture content it can however happen that the granular material issuing from the annular gap 7 at high speed adheres to the housing wall so that accumulations of granular material form there, which can then uncontrolledly detach from the wall. The pieces which become detached comprise small grains of granular material which adhere to each other and which cannot be used for further processing.

Therefore the conditioner according to the invention has an elastic curtain 11 so arranged that the granular material grains issuing from the annular gap 7 firstly hit the elastic curtain 11. The elastic curtain 11 which is of a bell-shaped configuration in the preferred embodiment is arranged spaced relative to the wall of the catch container 10 so that, upon impact of granular materials, it is caused to oscillate, which provides that the probability of granular material remaining clinging to the elastic curtain is markedly reduced. Nonetheless the possibility of individual grains of granular material adhering to the curtain can also not be excluded here. Therefore the curtain is so arranged that the grains issuing from the annular gap meet the elastic curtain 11 substantially at an impact angle of about 40 to 50 degrees. That has the advantage that a grain of granular material which is already adhering to the elastic curtain 11 is not pressed against the elastic curtain by the impact of a further grain, but is displaced thereon by the impact thereon of the following particle, which generally has the effect that the grain adhering to the curtain is detached and dropped into the catch container 9.

In the particularly preferred embodiment the elastic curtain is of a substantially S-shaped configuration in cross-section, that is to say it has a concave region and an adjoining convex region, wherein the concave region is arranged closer to the annular gap 7. In that respect the curtain 11 is so arranged that the granular material issuing from the gap meets the curtain substantially in the proximity of the connection between the concave region and the convex region.

Figure 4:
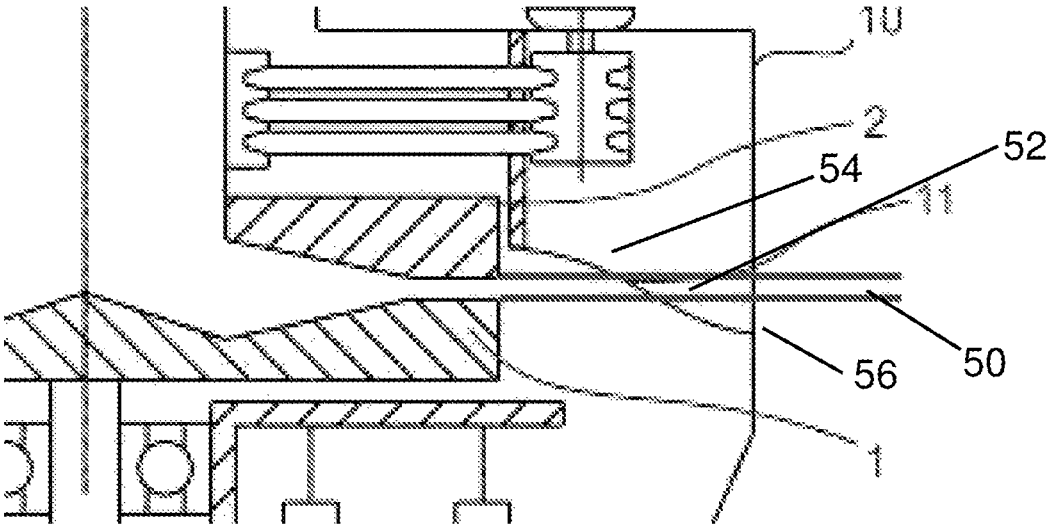
FIG. 4 is an enlarged view of a portion of the conditioner shown in FIG. 2.

As can be seen in FIG. 4, the notional radial prolongation 50 of the annular gap 7 intersects the elastic curtain 11 at an angle 52, and the elastic curtain 11 has an "S"-shaped cross-section with a concave downward portion 54 and a convex downward portion 56, which meet at the intersection of the notional radial prolongation 50 and the elastic curtain 11.

To be able to adjust the size of the granular material by altering the width of the annular gap 7 one of the rotating discs 1 or 2 is mounted adjustably in height. Height adjustment of the gap 12 can be effected by way of a mounting point or by way of a plurality of and preferably three mounting points so that, besides the gap width, it is also possible to adjust 15 the parallelism of the discs relative to each other by individual adjustment of the mounting points, the plurality of mounting points thus comprising a pivoting device 24.

The peripheral speed of at least one disc should be more than 10 m/s and preferably more than 20 m/s. When the discs are driven the one disc should involve a peripheral speed which is at least 10% greater than the peripheral speed of the other disc.

Figure 3:
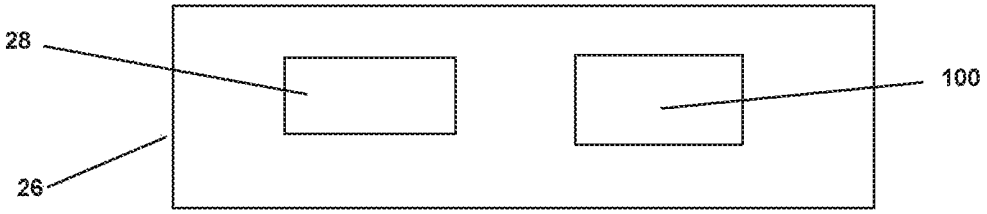

The present invention also provides apparatus 110 for the production of an optirinised granular material comprising a housing 26 in which there are arranged a granulating mixer 28 for producing a granular material from powders and possibly liquid and a granular material conditioner 100, as shown schematically in FIG. 3.

LIST OF REFERENCES

1 lower disc
2 upper disc
3 granular material
4 hollow shaft
5 cone
6 vanes
7 annular gap
8 shaft
9 catch container
10 catch container wall
11 curtain
12 gap height adjustment

The invention claimed is:

1. A granular material conditioner for granular materials comprising two discs which are rotatable relative to each other and which are arranged in parallel, a granular material inlet through which granular material passes into the conditioner into an annular gap between the two discs, and a catch container for receiving the granular material which issues from the gap between the two discs by virtue of centrifugal force, characterised in that the catch container has a wall and an elastic curtain, wherein at least a portion of the curtain is spaced from the catch container wall and limits the trajectory of the granular material issuing from the gap, the elastic curtain including an angle of between 15° and 75° with a notional radial prolongation of the annular gap, the elastic curtain having an S-shaped cross-section, and a concave portion closer to the gap and a convex portion adjoining the concave portion, wherein the notional radial prolongation of the annular gap intersects the elastic curtain in the proximity of the connection between the concave portion and the convex portion.

2. A granular material conditioner according to claim 1 characterised in that the elastic curtain is arranged completely surrounding the pair of discs.

3. A granular material conditioner according to claim 2 characterised in that the elastic curtain is of a bell-shaped configuration.

4. A granular material conditioner according to claim 1 characterised in that the elastic curtain is substantially flat at the side towards the gap, without knobs, grooves or ribs.

5. A granular material conditioner according to claim 1 characterised in that both discs are rotatable about their disc axis.

6. A granular material conditioner according to claim 1 characterised in that one of the two discs has a central opening, by way of which the granular material can be fed into the annular gap.

7. A granular material conditioner according to claim 6 characterised in that the disc which has the central opening is drivable with a hollow shaft, through which the granular material is fed into the gap by way of the central opening.

8. A granular material conditioner according to claim 1 characterised in that the two discs are oriented horizontally perpendicular to the vertical direction.

9. A granular material conditioner according to claim 8 wherein there is provided a pivoting device, by means of which one disc of the two discs, is pivotable about a pivot axis which extends parallel to the plane of the gap.

10. A granular material conditioner according to claim 9, wherein the pivotable disc is the upper disc.

11. A granular material conditioner according to claim 1 characterised in that the annular gap has one or more portions which are conical in cross-section.

12. A granular material conditioner according to claim 1 characterised in that at least one disc of the two discs is driven at a peripheral speed of more than 10 m/s.

13. A granular material conditioner according to claim 12 wherein when both discs are driven the peripheral speeds of the two discs are different.

14. A granular material conditioner according to claim 13 the peripheral speed of the one disc is at least 10% greater than the peripheral speed of the other disc.

15. A granular material conditioner according to claim 1 characterised in that the discs are substantially flat at their surfaces forming the gap.

* * * * *